US005630468A

United States Patent [19]

McKee

[11] Patent Number: 5,630,468

[45] Date of Patent: May 20, 1997

[54] SALAD BAR UNIT WITH REFRIGERATED OVERHEAD STORAGE CABINET

[75] Inventor: James C. McKee, Coopersburg, Pa.

[73] Assignee: Clemens Markets, Inc., Kulpsville, Pa.

[21] Appl. No.: 515,949

[22] Filed: Aug. 16, 1995

[51] Int. Cl.[6] ..... F25B 29/00

[52] U.S. Cl. ..... 165/48.1; 62/258; 165/918

[58] Field of Search ..... 62/246, 252, 254, 62/255, 258; 165/918, 48.1

[56] References Cited

U.S. PATENT DOCUMENTS

| | | | |
|---|---|---|---|
| 2,687,621 | 8/1954 | Fitzgerald | 62/254 |
| 3,204,421 | 9/1965 | Jirel | 62/252 |
| 4,572,598 | 2/1986 | Moore, Jr. | 62/246 |
| 4,856,579 | 8/1989 | Wolfe | 165/918 |
| 5,247,807 | 9/1993 | Jerman et al. | 165/918 |
| 5,363,672 | 11/1994 | Moore et al. | 165/918 |

*Primary Examiner*—William E. Tapolcai

*Attorney, Agent, or Firm*—Panitch Schwarze Jacobs & Nadel, P.C.

[57] ABSTRACT

A salad bar unit with an overhead refrigerated storage cabinet wherein the salad bar at waist height contains a variety of containers, some of which are cooled and some of which are hot, and which are used to hold various food items to be selected by consumers. The unit is provided with an overhead cabinet that is divided into a plurality of independent refrigerated stalls open at one end, with transparent dividers, and having interior racks carrying containers of soda, milk, fruit juice and other items to which access is available through transparent doors that close off the open ends of the stalls.

8 Claims, 4 Drawing Sheets

SALAD BAR UNIT WITH REFRIGERATED OVERHEAD STORAGE CABINET

BACKGROUND OF THE INVENTION

1. Field of the Invention

This invention relates to a salad bar unit of the type used for storing and dispensing hot and cold food items, and which has an overhead refrigerated cabinet that stores beverages and other items.

2. Description of the Prior Art

The demand for various prepared cold food items such as fruit, vegetables, desserts and other salad items, as well as precooked hot items such as wings, and ribs, has increased considerably due to the increase in the number of working persons, and the decrease in available time for home meal preparation. As a result refrigerated salad bars and separate hot food bars are now present in many markets. Persons selecting food items often purchase soda, fruit juice and other beverages that compliment the salad or hot bar selection. It has been observed that many purchases are impulse purchases, and that customers are influenced in their purchases by the display and ready availability of merchandise. Accordingly it is desirable to be able to present the consumer with a wide variety of hot and cold food items, and simultaneously to provide beverages that compliment the food items. Various salad bar constructions have been proposed such as shown in the following U.S. Pat. No. Design 92,122 to Weiss, U.S. Pat. No. Design 220,140 to Perl, U.S. Pat. No. Design 288,040 to LeBlanc, U.S. Pat. No. Design 326,024 to Boyd et. al., U.S. Pat. No. 2,900,045 to Conklin et. al., and U.S. Pat. No. 4,572,598 to Moore, Jr. No satisfactory apparatus has been previously available. The present unit offers the consumer in one location, a variety of hot and cold food items, and a selection of refrigerated beverages and other items in a self contained unit that can be easily installed, stocked and maintained.

SUMMARY OF THE INVENTION

This invention relates to a salad bar unit with a refrigerated overhead storage cabinet having stalls therein, which unit presents a variety of hot and cold food items at waist level, and presents refrigerated beverages and other items in a cabinet above the food items, all in one self contained unit.

The principal object of the invention is to provide a salad bar and refrigerated overhead storage cabinet in a self contained unit.

A further object of the invention is to provide a unit of the character aforesaid that is easy to install, stock and maintain.

A further object of the invention is to provide a unit of the character aforesaid which appeals to impulse buyers of food and beverage items.

A further object of the invention is to provide a unit of the character aforesaid that provides quick and easy access to both food and beverage items.

A further object of the invention is to provide a unit that can be easily serviced, and is efficient in operation.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
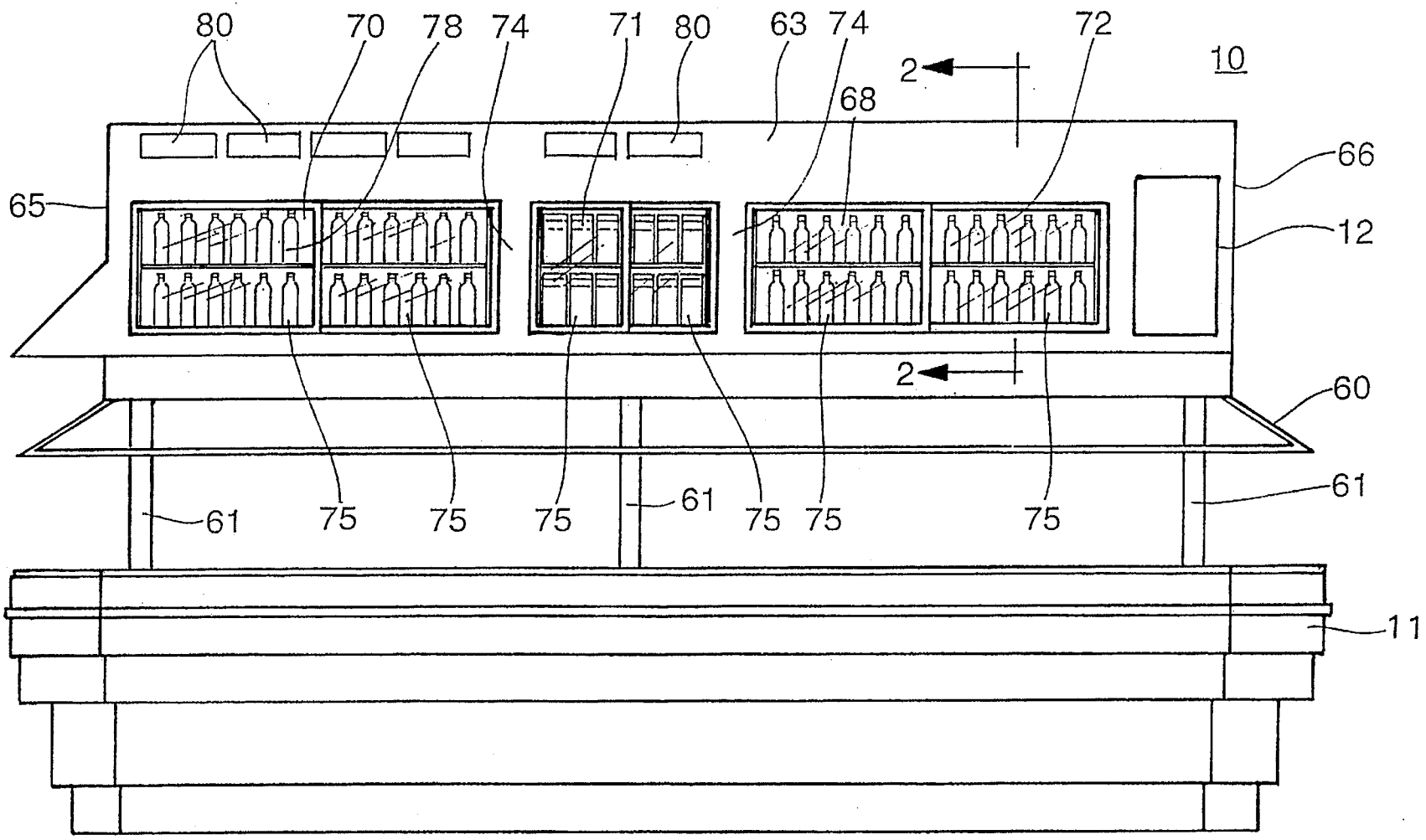
FIG. 1 is a side elevational view of the salad bar with refrigerated overhead storage cabinet of the invention.
Figure 3:
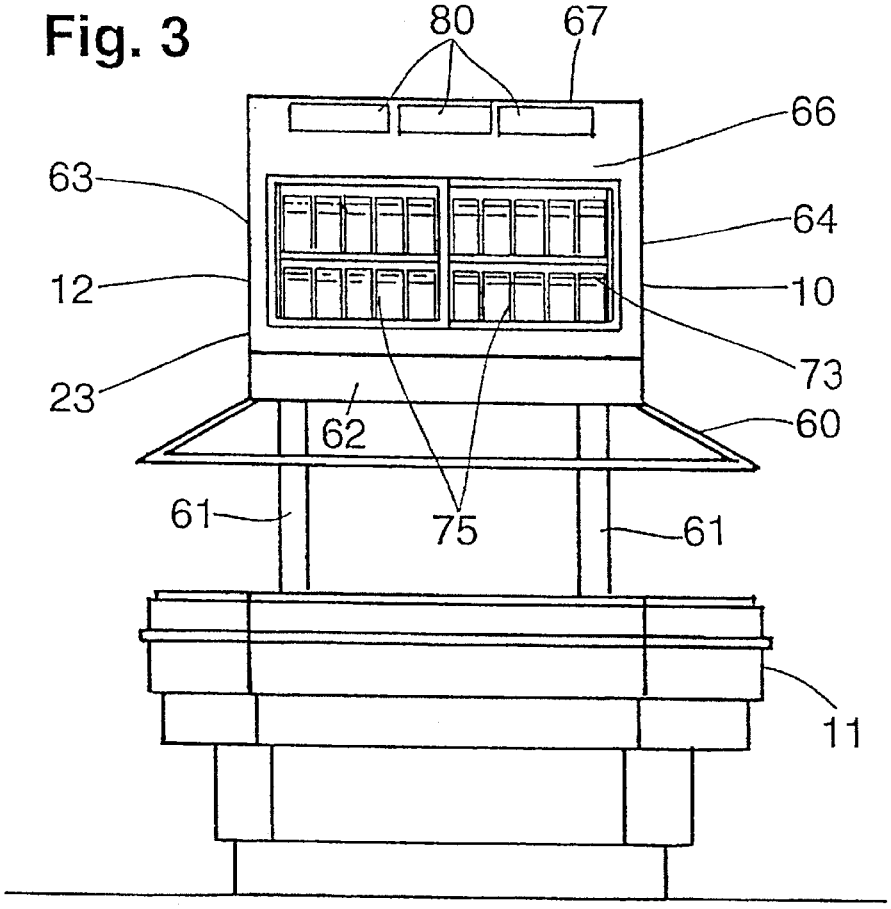
FIG. 3 is an end elevational view of the invention.

It should, of course, be understood that the description and drawings herein are merely illustrative, and that various modifications and changes can be made in the structure disclosed without departing from the spirit of the invention.

Like numerals refer to like parts throughout the several views.

DESCRIPTION OF THE PREFERRED EMBODIMENT

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to FIGS. 1–3 and 5 of the drawings, one embodiment of the salad bar overhead refrigerated unit 10 of the invention is illustrated.

The unit 10 comprises a salad bar 11 at waist height, with an overhead cabinet 12 thereabove and connected thereto, which is refrigerated, and which cabinet supports the mechanical refrigeration and electrical components of the unit, to be described.

The salad bar 11 is of rectangular configuration as seen from the top, with top wall 18, side walls 20 and 21, and end walls 22 and 23.

Figure 5:
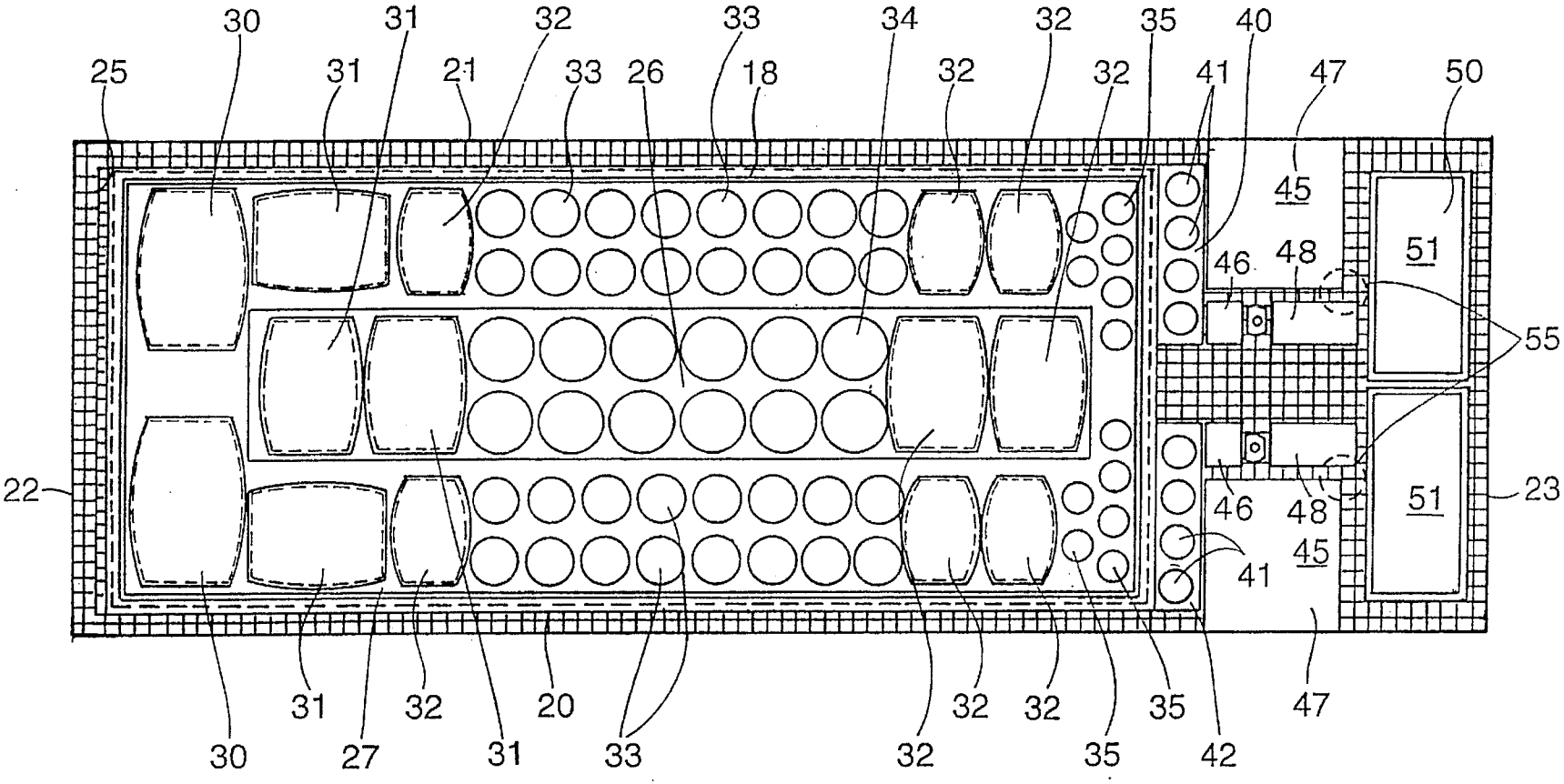
FIG. 5 is a top plan view, enlarged, of the hot and cold food salad bar portion of the invention.

As shown in FIG. 5 the salad bar 11 at the left end wall 22, has a recessed area 25 in wall 18 which extends transversely thereacross between the side wall 20 and 21, and which is used to store empty salad containers and other accessories (not shown) which are to be used by the consumer.

To the right of area 25 is a cold storage area 26, which has a plate 27 recessed down from the top wall 18, wherein a plurality of containers 30, 31, 32, 33, 34 and 35 are provided, which are filled with the food items (not shown) to be selected by consumers. The area 26 is kept refrigerated by well known refrigeration equipment therebelow (not shown), which is connected to the mechanical equipment (to be described) carried on top of overhead cabinet 12.

To the right of area 26 an additional storage area 40 is provided, which is illustrated with eight openings 41 in plate 42, which can hold containers (not shown) for salad dressings. To the right of area 40, area 45 is provided, which includes recesses 46 for plastic ware (not shown), and recesses 47 for soup pots (not shown). Additional recesses 48 are also provided for other containers (not shown). To the right of area 45, area 50 is provided, which has hot well recesses 51 which are heated, and in which containers (not shown) holding food items to be kept hot can be placed. At least two heat lamps 55 are provided mounted to cabinet 12, and located over areas 45 and 50 to assist in maintaining the proper temperature in these areas. A sneeze shield 60 is provided which is mounted to the overhead cabinet 12, and extends around it over the salad bar 11. The sneeze shield 60 is preferably constructed of transparent safety glass, and is intended to protect the food items (not shown) from contamination by consumers.

The overhead cabinet 12 is attached to the salad bar 11 by columns 61, which can be hollow and constructed of stainless steel or other suitable material. The columns 61 support the cabinet 12, and carry electric and refrigeration lines therein (not shown) as desired. The cabinet 12 as seen from the top is of rectangular configuration similar to salad bar 11, but of lesser overall size. The upper or overhead cabinet 12 has a bottom wall 62, side walls 63, 64, end walls 65, 66 and top wall 67.

The interior space 68 between the walls, 62, 63, 64, 65, 66 and 67 is divided into a plurality of stalls 70, 71, 72 on each side, and stall 73 at one end, by channel members 74, which do not restrict air movement in the interior space 68 in cabinet 12.

The interior space 68 is refrigerated by the equipment carried on top of cabinet 12 (to be described), and preferably by circulating chilled air in the space 68.

Figure 2:
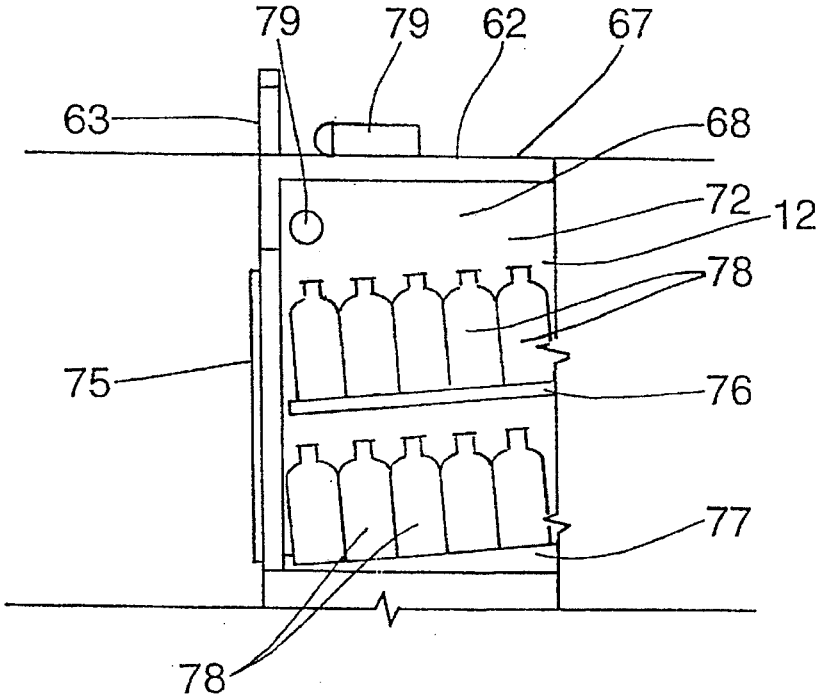
FIG. 2 is a vertical sectional view taken approximately on the line 2—2 of FIG. 1.

The stalls 70, 71, 72 on each side are further divided in half, and a pair of doors 75 are provided at each of the open ends of the stalls, which are slidable in channels (not shown) carried in cabinet 12. Each of the doors 75 can be opened and closed to provide access to the particular stall desired. The stalls 70, 71 and 72 are provided with racks 76 and 77, which carry stacks of cartons or bottles 78 as shown in FIG. 2, and can be sloped downwardly to urge the bottles 78 to move toward the doors 75. A plurality of lights 79 are provided adjacent to the stalls 70, 71, 72 and 73 for illumination. Above the stalls 70, 71, 72 and 73 display panels 80 are provided in walls 63, 64, 65, and 66, which can carry logos that advertise and identify the brands of beverages and other items that are carried in the stalls 70, 71, 72 and 73.

Figure 6:
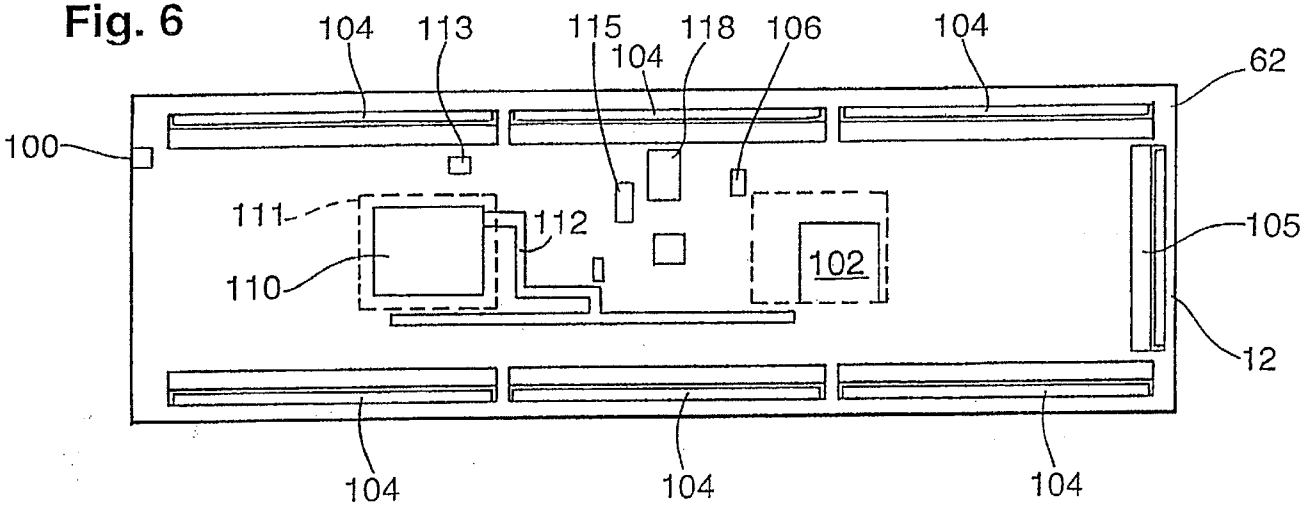
FIG. 6 is a view similar to FIG. 4 illustrating the electrical wiring of the equipment portion of the invention.
Figure 4:
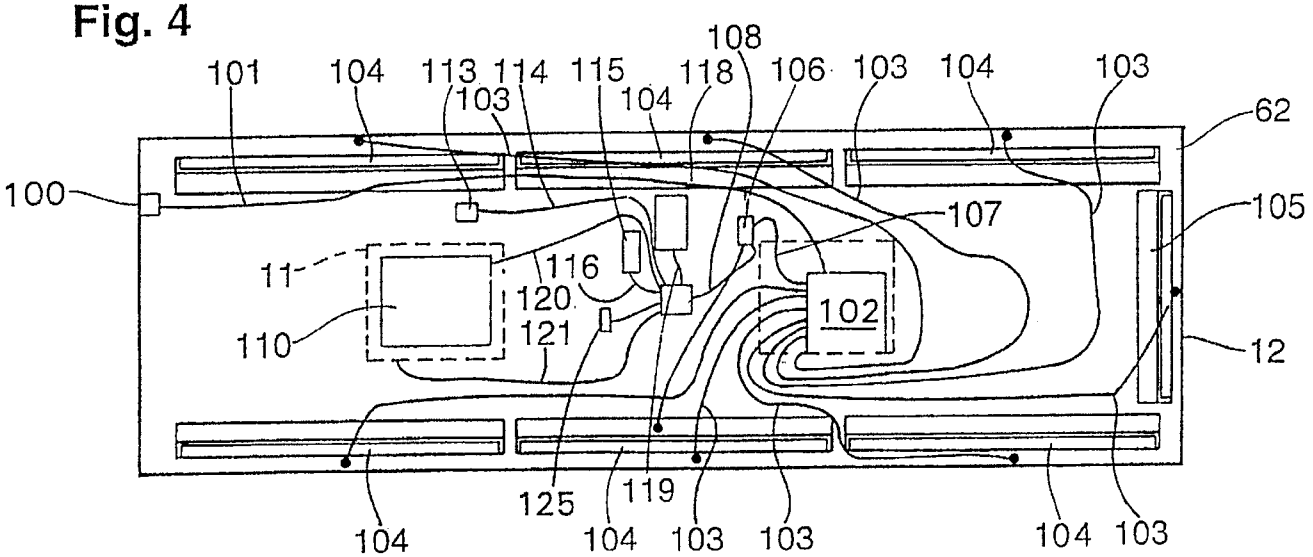
FIG. 4 is a top plan view of the equipment portion of the invention.

Referring now to FIGS. 4 and 6, the refrigeration equipment and electric wiring for the unit 10 is illustrated.

The equipment includes a light switch 100 connected by wire 101 to a lighting ballast box 102, which has wires 103 connected thereto and to lighting fixture 104 and 105 in well known manner. A lighting junction box 106 is provided connected to lighting ballast box 102 by wire 107, and to a source of electrical power (not shown) by wire 108.

The refrigeration equipment includes a condensing unit 110, an evaporator unit 111, refrigeration lines 112, and a low pressure control 113, which is connected to a ceiling mounted junction box (not shown) by wire 114. A thermostat 115 is provided connected to the ceiling mounted junction box (not shown) by wire 116.

A defrost time clock 118 is provided connected to junction box (not shown) by wire 119. Condensing unit 110 is connected to junction box (not shown) by wire 120, and evaporator unit 111 is connected to junction box (not shown) by wire 121.

A pump down solenoid 125 of well known type, is provided to supply refrigerant (not shown) down to the salad bar for cooling. Additionally a fan is provided (not shown) inside cabinet 12 to circulate chilled air from the evaporator units 111 to the space 68 inside cabinet 12.

A hollow conduit (not shown) is provided, which carries the electric lines 108, 114, 116, 119, 120 and 121 to the junction box (not shown), which is preferably mounted on the ceiling (not shown) above the cabinet 12.

It will thus be seen that a salad bar unit with refrigerated overhead storage cabinet has been provided with which the objects of the invention are achieved.

I claim:

1. A salad bar unit which comprises:

a salad bar having a first, hot portion to hold and present hot food items and a second, cold portion to hold and present cold food items, a storage cabinet positioned a distance above and mounted to said salad bar to present cold food items, a refrigeration unit for refrigerating the second, cold portion of the salad bar and for refrigerating the storage cabinet, and a heater unit for heating the first, hot portion of the salad bar.

2. A salad bar unit as defined in claim 1 in which said refrigeration unit is located on top of said storage cabinet.

3. A salad bar unit as described in claim 1 in which said cabinet is divided into a plurality of stalls open at one end, and at least one door is provided at the stall open ends to provide access to said stalls.

4. A salad bar unit as described in claim 1 in which a sneeze shield is mounted to said storage cabinet above said salad bar.

5. A salad bar unit which comprises:

a salad bar to hold and present food items;

a storage cabinet positioned a distance above and mounted to the salad bar to present cold food items;

a refrigeration unit for refrigerating the salad bar and for refrigerating the storage cabinet, and a heater unit for heating the salad bar.

6. A salad bar unit as defined in claim 5 in which the refrigeration unit is located on top of the storage cabinet.

7. A salad bar unit as described in claim 5 in which the cabinet is divided into a plurality of stalls open at one end, and at least one door is provided at the stall open ends to provide access to the stalls.

8. A salad bar unit as described in claim 5 in which a sneeze shield is mounted to the storage cabinet above the salad bar.

* * * * *